United States Patent [19]

Orihara

[11] 4,063,711

[45] Dec. 20, 1977

[54] CABLE GUIDING DEVICE

[75] Inventor: Sizuo Orihara, Toyokawa, Japan

[73] Assignee: Tokyo Seiko Rope Manufacturing Co., Ltd., Japan

[21] Appl. No.: 721,332

[22] Filed: Sept. 8, 1976

[30] Foreign Application Priority Data

Sept. 10, 1975 Japan ..... 50-110270
Jan. 29, 1976 Japan ..... 51-8721

[51] Int. Cl.[2] ..... B66D 11/38
[52] U.S. Cl. ..... 254/134.3 R
[58] Field of Search ..... 254/134.3 R, 134.3 PA, 254/134.3 CL, 192–193; 259/DIG. 28, 84, 104, 6, 21, 40

[56] References Cited

U.S. PATENT DOCUMENTS 267,491 11/1882 Carley ..... 259/DIG. 28
1,383,336 7/1921 Phillips ..... 259/104
3,834,674 9/1974 Jackson ..... 254/134.3 R

FOREIGN PATENT DOCUMENTS 65,892 11/1947 Denmark ..... 259/DIG. 28

*Primary Examiner*—Robert C. Watson

[57] ABSTRACT

A device for guiding cables has a pair of rotors and detent elements fitted to the periphery of each of the rotors at an equal circumferential interval, wherein the detent elements of one of the paired rotors are so disposed as to be engaged with those of the counterpart rotor; the detent elements are each so arranged as to define a space for allowing the passage of a carrier suspension members hanging from a cable; a cable-guiding section is provided adjacent to the detent elements of one of the paired rotors to support and guide the cable in co-operation with the cable-guiding section of the counterpart rotor.

26 Claims, 26 Drawing Figures

CABLE GUIDING DEVICE

BACKGROUND OF THE INVENTION

1. Field of the Invention

This invention relates to a cable guiding device used with, for example, an aerial cableway.

2. Description of the Prior Art

With a prior art single line aerial cableway used to transport, for example, freight, a cable was made to run while being guided through a groove provided in the outer periphery of a wheel or wheels mounted on a support pole in a state pressed against the groove by a separately provided tension wheel so as to be prevented from being readily thrown off the groove. However, the prior art cable guiding device had the drawbacks that since carriers for holding freight were suspended from the cable, the cable guiding device had a complicated construction to allow the carriers to pass through the wheels, and that the separately provided tension wheel only served to render the cable less liable to come off the wheel groove and was not fully effective to unfailingly prevent the loosening of the cable off the wheel groove.

SUMMARY OF THE INVENTION

It is an object of this invention to provide a cable guiding device of simple construction which is designed to unfailingly prevent the coming off of a cable from its guiding means.

Another object of the invention is to provide a cable guiding device which allows the passage of carriers for passengers or freight hanging from the cable without any hindrance.

According to this invention, there is provided a cable guiding device, which comprises a pair of rotors disposed adjacent to each other; detent elements provided for each of the paired rotors at an equal circumferential interval such that the detent elements of both rotors are engageable with each other at the most closely facing portions of the rotors and are so arranged as to define a space for allowing the passage of suspension members holding carriers hanging from a cable guided by the cable guiding device; and means for guiding the cable by the engaged portion of the detent elements of both rotors. When drawn lengthwise by a driving device, the cable travels onward while being supported by the cable guiding device. Both rotors are rotated by the running of the cable. When brought to those of the detent elements which are engaged with each other, the suspension members can always be disposed in the space, and can pass between both rotors.

DETAILED DESCRIPTION OF THE PREFERRED EMBODIMENTS

Figure 1:
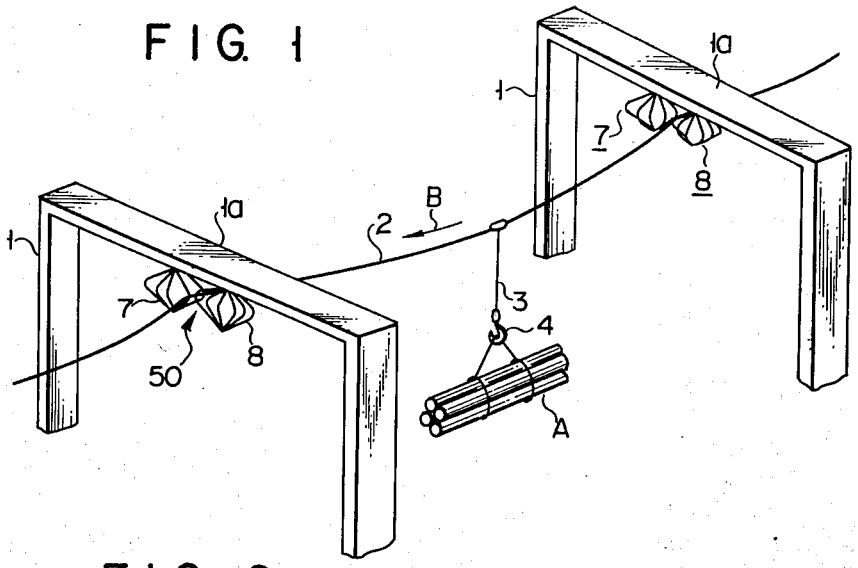
FIG. 1 is an oblique view of a lumber-transporting aerial cableway to which a cable guiding device according to one embodiment of this invention is applied.

There will now be described by reference to FIGS. 1 to 4 a cable guiding device according to one embodiment of this invention. FIG. 1 shows an aerial cable system for transporting lumber cut down in the mountains to, for example, the nearest rairlroad station. A long single cable 2 is carried by a plurality of gate type support poles 1 (only two are indicated) built at a plurality of points between the felling site and the nearest railroad station. Suspension ropes (or suspension members) 3 (only one is indicated) are hung from the cable 2 at an equal distance. The lower end of each suspension rope 3 is provided with a hook 4, acting as a carrier. A bundle A of cut down pieces of lumber is caught by the hook 4 with the aide of wires and transported in the direction of an arrow B to the nearest railroad station.

Figure 2:
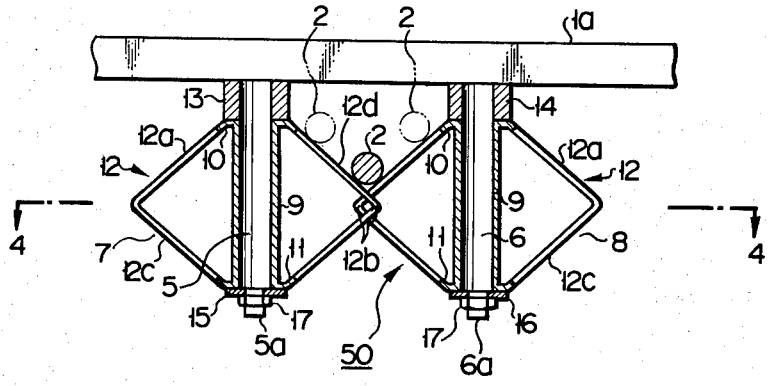
FIG. 2 is a longitudinal sectional view of the cable guiding device of FIG. 1.
Figure 3:
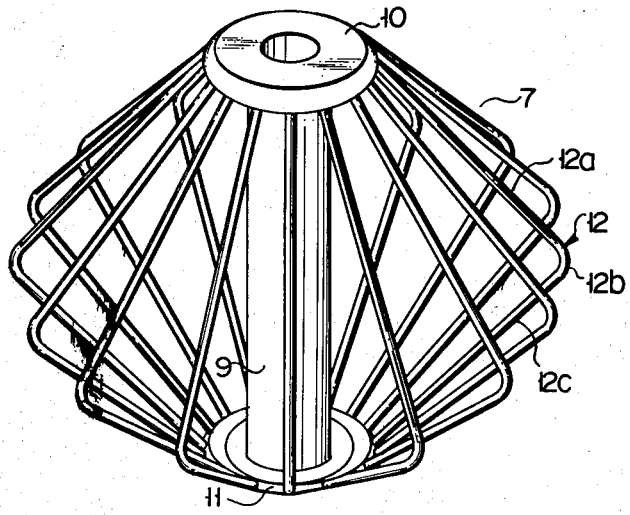
FIG. 3 is an oblique view of a rotor shown in FIG. 1.

There will now be described by reference to FIG. 2 a cable guiding device 50 for movably supporting the cable 2 on the gate type support pole 1. A pair of spatially arranged fixed shafts 5, 6 extending straight downward from the underside of the horizontal beam **1*a* of the gate type support pole 1 are inserted into the hollow cylindrical shaft 9 of a pair of rotors 7, 8 so as to rotatably support them. Since both rotors 7, 8 are of the same construction, only one of them is described by reference to FIG. 3. The upper and lower ends are integrally fitted with circular flanges 10, 11. The main body of the rotor 7 is formed of a plurality of round metal supporting members or rods 12 (hereinafter refered to as "supporting bars") bent outward at the center 12*b* in the V-shape. One side ends of the supporting bars 12 are fixed, for example, by welding to the periphery of the upper flange 10 of the hollow central shaft 9 at an equal circumferential interval, and the other side ends of the supporting bars 12 are similarly fixed to the periphery of the lower flange 11 of the hollow central shaft 9. The supporting bars 12 radially extend from the hollow central shaft 9**.

Both rotors 7, 8 are supported on the fixed shafts 5, 6 such that the central bends **12*b* of the supporting bars 12 engage each other on a central line between the fixed shafts 5, 6 and in the proximity thereof. The central bends 12*b* act like the teeth of a gear as later described, and hereinafter are referred to as "detent elements". The cable 2 runs between the fixed shafts 5, 6 and is supported on a V-shaped support portion 12*d* defined by the engaged detent elements 12*b* of the rotors 7, 8 (FIG. 2). Rollers 13, 14 disposed above the rotors 7, 8 are rototably mounted on the fixed shafts 5, 6. Thrust washers 15, 16 are fixed by nuts 17 to the threaded portions 5*a* , 6*a* provided at the lower ends of the fixed shafts 5, 6. The thrust washers 15, 16 prevent the rotors 7, 8** from being thrown out of place when subjected to a thrust.

There will now be described the operation of a cable guiding device according to one embodiment of this invention which is constructed as described above. A bundle A of cut down pieces of lumber is suspended by the suspension rope 3 to be carried to a railroad station nearest to a felling site. When the cable 2 travels in the direction of the arrow B by the driving device, the rotors 7, 8 are rotated as the result of the running of the cable 2 in the direction of arrows C, D respectively (FIG. 4) with the detent elements **12*b* of the supporting bars 12** engaged with each other.

Figure 4:
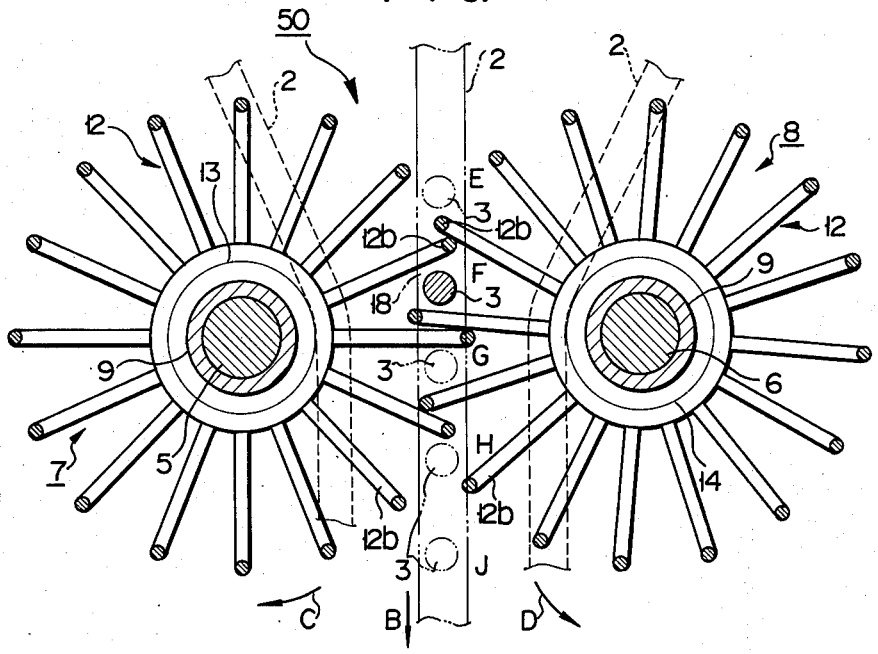
FIG. 4 is a sectional view on line 4—4 of FIG. 2.

There will now be described the manner in which the suspension rope 3 from which the bundle A of cut down pieces of lumber hangs, is made to pass between the rotors 7, 8. Referring to FIG. 4, the character E denotes the position of the suspension rope 3 right behind a pair of detent elements **12*b* which are just about to be engaged each other as the result of the running of the cable 2 in the direction of the arrow B. When the cable 2 further moves onward in the direction B, the rotors 7, 8 are rotated in the directions of the arrows C, D. Before the paired detent elements 12*b* immediately following the aforesaid preceding paired detent elements 12*b* which were just about to be engaged begin to be engaged, the suspension rope 3 occupying the position E is transported ahead of a point at which such succeeding paired detent elements 12*b* commence engagement. When the rotors 7, 8 are each rotated through a distance corresponding to an interval between every pair of adjacent detent elements, the suspension rope 3 is brought into a space 18 defined between the preceding and succeeding pairs of detent elements. When the cable 2 is further moved in the B direction, the suspension rope 3 travels onward while being kept, as shown by G, in the space 18 also advancing in the B direction. Later, the suspension rope 3 is guided, as shown by H, J, between the disengaged pair of detent elements 12*b* and is finally taken out of the rotors 7, 8. Therefore, the suspension rope 3 can smoothly pass between the rotors 7, 8 without being obstructed by the metal supporting bars 12 including the detent elements 12*b*. It is noted that the space 18 is wider than the diameter of the suspension rope 3**.

Under the normal condition, the cable 2 is supported in the V-shaped supporting portions **12*d* defined by the engaged upper half portions 12*a* of the supporting bars 12 of both rotors 7, 8. Where, however, the bundle A of cut down pieces of lumber sways sideways when blown by the wind, the suspension rope 3 also swings sideways, that is, along the surface of the V-shaped supporting portion 12*d* defined by the engaged upper half portions 12*a* as shown by the two-dot-chain circles of FIG. 2. Since the upper half portions 12*a* are inclined downward toward the engaged junction of the rotors 7, 8, the suspension rope 3 undergoes a force to pull the rope 3 by the weight of the lumber toward the bottom of the V-shaped cable supporting portion 12*d*. As the result, the cable 2 occupies a position indicated by a solid circle in FIG. 2**.

When abnormally swaying sideways, the cable 2 is pressed against the rollers 13, 14 as shown by broken lines in FIG. 4 to be prevented from further swaying. In this case, too, the cable 3 regains the solid circle position of FIG. 2 for the same reason as given above.

Further where the cable 2 slides sideways, the space 18 is made sufficiently wide to allow the suspension rope 3 to pass between the rotors 7, 8 in a state similarly sliding sideways.

According to the above-mentioned embodiment, a pair of rotors 7, 8 rotate while the supporting bars 12 are engaged with each other. The cable 2 is securely held by the supporting portion **12*d* of the supporting bars 12 and prevented from being thrown off the rotors 7, 8, thus enabling the cable 2** to run with greater safety than has been possible in the prior art cable guiding device.

The suspension rope 3 which passes between the rotors 7, 8 while being kept within the space 18 defined by the mutually engaged detent elements **12*b* of the supporing bars 12 eliminates the necessity of providing any particular device to ensure the safe and smooth passage of the suspension rope 3 between the rotors 7, 8. Therefore, the cable guiding device of this invention is of simple construction and reduced in weight due to the rotors 7, 8 being formed of a plurality of supporting bars 12** arranged radially.

The detent elements of the supporting bars 12 of both rotors 7, 8 jointly define the V-shaped supporting portion **12*d*. Therefore, even when swaying sideways, the cable 2 regains the normal position at the bottom of said V-shaped supporting portion 12*d* by sliding downward along the V-shape supporting portion 12*d* by the weight of the cable 2** and the lumber.

Figure 5:
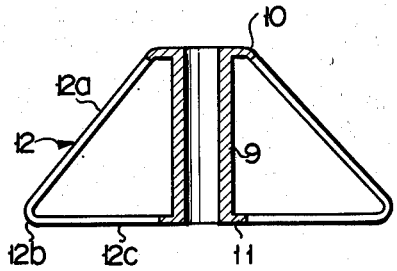
FIG. 5 is a longitudinal sectional view of a rotor according to another embodiment of the invention.

With the foregoing embodiment, the lower half portions **12*c* of the supporting bars 12 mechanically reinforce the upper half portions 12*a* of the supporting bars 12 which directly bear the load of the cable 2 carrying, for example, many lumber bundles. The lower half portions 12*c* may take a substantially horizontal position as shown in FIG. 5. With a modified metal supporting bars $12_1$ of FIG. 6, the lower half portions 12*c* of the foregoing embodiment may each be replaced by that type which extends from the bottom of the hollow shaft 9 to the underside of the intermediate point of each upper half portion 12*a* to act as support rods 20**.

Figure 7:
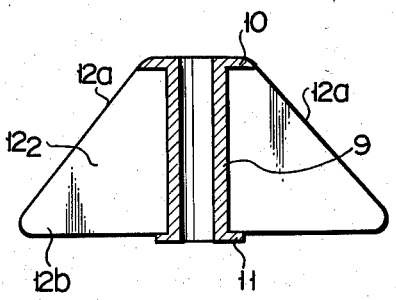
FIG. 7 is a longitudinal sectional view of a rotor according to still another embodiment of the invention.

Further, the supporting bars 12 of FIG. 5 may be substituted, as shown in FIG. 7, by a plurality of plates or wing members $12_2$ shaped substantially like a right-angled triangle which are fixed to the hollow shaft 9 with the vertical side of the triangle pressed against the hollow shaft 9. In this case, the inclined side **12*a* of the triangle corresponds to the upper half portion 12*a* of each supporting bar 12 of FIG. 5**.

Figure 6:
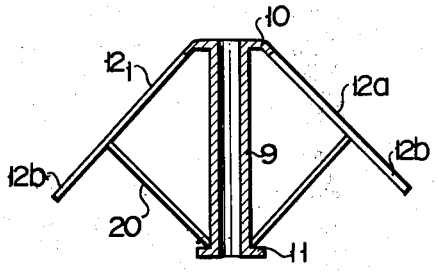
FIG. 6 is a longitudinal sectional view of a rotor according to another embodiment of the invention.
Figure 8:
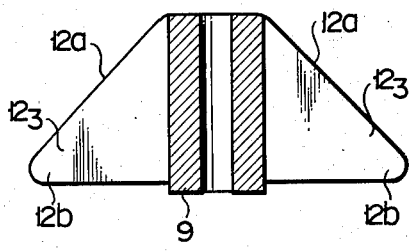
FIG. 8 is a longitudinal sectional view of a rotor according to a further embodiment of the invention.
Figure 9:
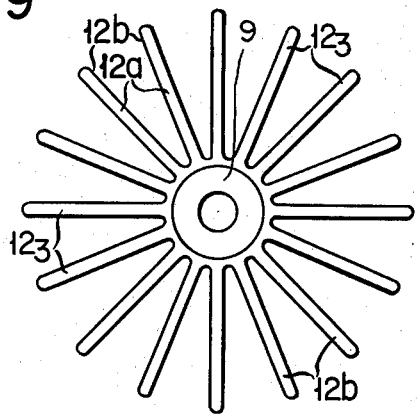
FIG. 9 is a plan view of FIG. 8.

Apart from the modifications of FIGS. 5 to 7, a plurality of plates or wing members $12_3$ shaped substantially like a right-angled triangle may be integrally formed, as shown in FIGS. 8 and 9, with a hollow shaft 9 on the periphery therof at an equal circumferential interval, with the vertical side of the triangle connected to the hollow shaft 9. In the embodiments of FIGS. 7 to 9, a portion 12*b* formed by the intersection of the inclined plane 12*a* and the base 12*c* of the right-angled triangle constitutes a detent elemet 12*b*.

The two modifications of FIGS. 7 to 9 are characterized in that the supporting members $12_2$, $12_3$ have a greater mechanical strength than the supporting members 12, $12_1$ of the embodiment of FIGS. 1 and 6.

Figure 10:
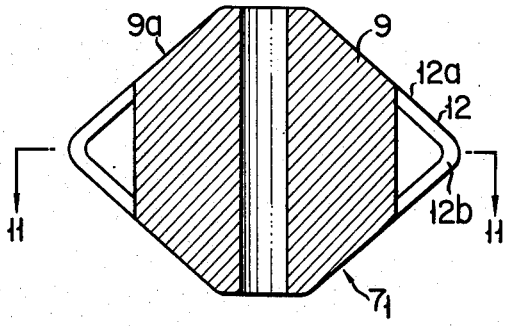
FIG. 10 is a longitudinal sectional view of a rotor according to a still further embodiment of the invention.
Figure 11:
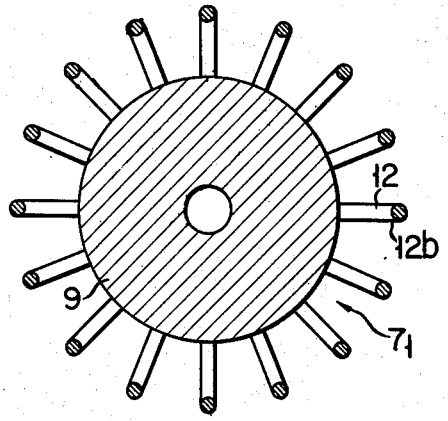
FIG. 11 is a sectional view on line 11—11 of FIG. 10.

FIGS. 10 and 11 jointly show a rotor according to a still another embodiment of the invention. The rotor $7_1$ comprises a shaft 9 which has a larger diameter than the shaft used with the embodiments of FIGS. 1 to 9, and the upper and lower end portions of which are each chosen to have a conical surface. The upper conical surface 9*a* of the shaft 9 corresponds to the upper half portions 12*a* of the rotors 7, 8 shown in FIGS. 2 to 4. Fixed to the periphery of the rotor $7_1$ are a plurality of V-shaped supporting bars 12 extending outward continuously with the upper and lower conical surfaces in the radial direction at an equal circumferential interval. The supporting bars 12 are made shorter than those of FIGS. 2 to 4 and collectively form detent elements.

Figure 12:
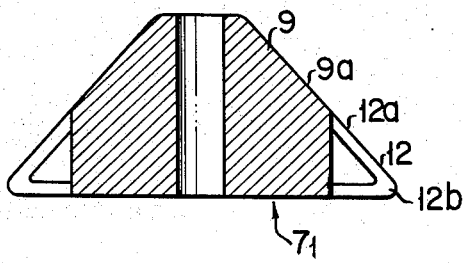
FIG. 12 is a longitudinal sectional view of another embodiment of a rotor of the invention.
Figure 13:
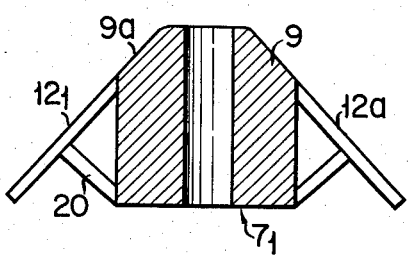
FIG. 13 is a longitudinal sectional view of another embodiment of a rotor of the invention.
Figure 14:
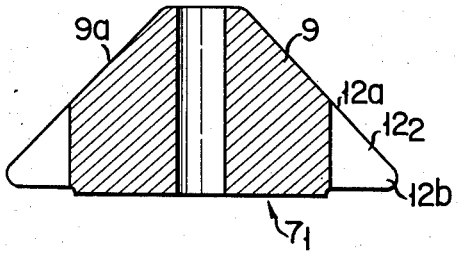
FIG. 14 is a longitudinal sectional view of a further embodiment of a rotor of the invention.
Figure 15:
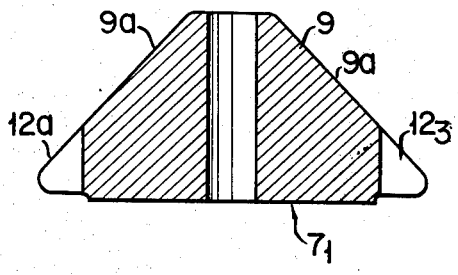
FIG. 15 is a longitudinal sectional view of a still further embodiment of a rotor of the invention.
Figure 16:
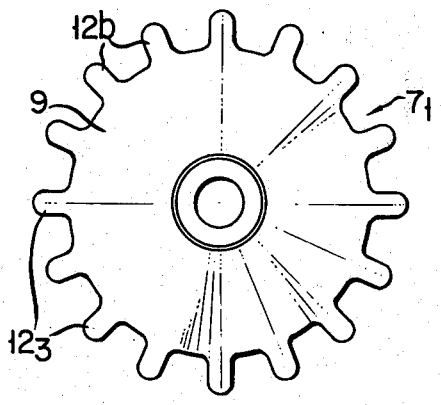
FIG. 16 is a plan view of FIG. 15.

The rotor of FIG. 12 is modified from that of FIG. 5, the rotor of FIG. 13 is modified from that of FIG. 6, the rotor of FIG. 14 is modified from that of FIG. 7; and the rotor of FIGS. 15 and 16 is modified from that of FIGS. 8 and 9. The corresponding parts of the rotors of FIGS. 12, 13, 14, 15 and 16 are denoted by the same numerals as those of FIGS. 5, 6, 7, 8 and 9.

The central shafts 9 of the rotors $7_1$ of FIGS. 12 to 16 are chosen to have a larger diameter than the central shafts 9 of the corresponding rotors $7_1$ of FIGS. 5 to 9, like the central shaft 9 of the rotor $7_1$ of FIGS. 10 and 11. The upper end portions of the central shafts 9 of the rotors $7_1$ of FIGS. 12 to 16 have a conical surface 9*a*, thereby effecting the same function as the upper half portions or inclined planes of the rotors of FIGS. 5 to 9. The upper half portions or inclined planes 12*a* of the elements 12, $12_1$, $12_2$, $12_3$ extend continuously with the conical surfaces 9*a* of the corresponding rotors.

As seen from FIG. 16, the rotor $7_1$ of FIGS. 15 and 16 is shaped like a gear, and the detent elements of the rotor $7_1$ resemble gear teeth.

The embodiments of FIGS. 10 to 16 have the advantage that the rotor has prominently great rigidity, though increased in weight due to application of a thicker central shaft 9.

FIGS. 17 to 20 show another embodiment of a cable guiding device according to this invention which is applied to an ore collecting vessel 21 to collect ores out of the sea bed. The parts of FIGS. 18 to 20 the same as those of FIG. 2 are denoted by the same numerals, description being only given of different parts. A cable 23 runs in the direction of an arrow H shown in FIG. 17 to circulate between the vessel 21 and sea bed (not shown).

Figure 18:
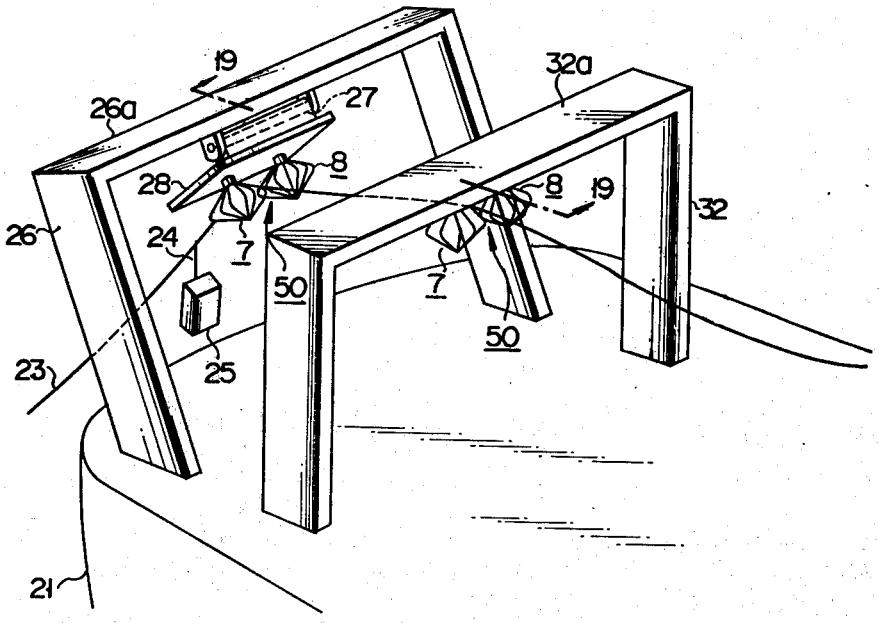
FIG. 18 is an enlarged oblique view of the main part of FIG. 17.
Figure 19:
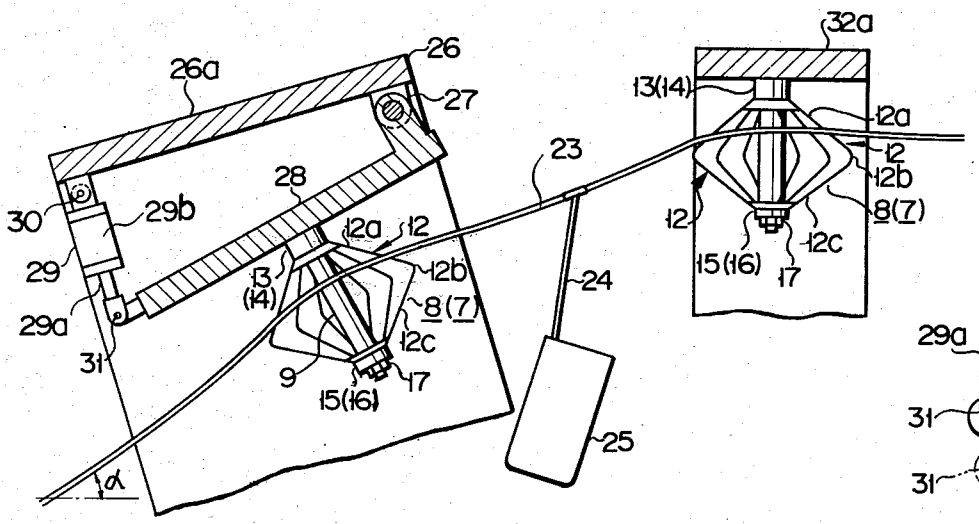
FIG. 19 is a sectional view on line 19—19 of FIG. 18.

A plurality of buckets 25 connected to the lower end of suspension ropes 24 hanging from the cable 23 at a prescribed interval are used to carry ores out of the sea bed. A gate type support pole 26 is erected, as shown in FIG. 18, on the stern of the vessel 21 in an outward inclined state. Referring to FIG. 18, a horizontal pivotal shaft 27 is mounted on the underside of a horizontal beam 26*a* of the gate type support pole 26 by means of brackets. The rear edge of an adjusting plate 28 is swingably mounted on the pivotal shaft 27. The underside of the adjusting plate 28 is fitted with a pair of rotors 7, 8 which rotate with the supporting bars 12 of the rotors 7, 8 engaged with each other. As shown in FIG. 19, the cylinder 29*b* of a hydraulic piston-cylinder assembly 29 is pivoted by a pin 30 to the underside of the horizontal beam 26*a* of the gate type support pole 26. The free end of the piston-rod 29*a* of the piston-cylinder assembly 29 is also pivoted, is shown in FIG. 12, by a pin 31 to the forward edge of the adjusting plate 28. Another gate type support pole 32 is built substantially upright near the inclined gate type support pole 26 on the deck at the stern of the vessel 21. The underside of the horizontal beam 32*a* of the gate type support pole 32 is fitted with a pair of those rotors 7, 8 of the same construction as of FIGS. 1 to 4 which rotate with the detent elements 12*b* of the metal supporting members 12 thereof engaged with each other. The cable 23 is supported, as shown in FIG. 19, at two portions, that is, by the paired rotors 7, 8 on the adjusting plate 28 and the pair of rotors 7, 8 on the horizontal beam 32*a*of the upright gate type support pole 32.

Figure 20:
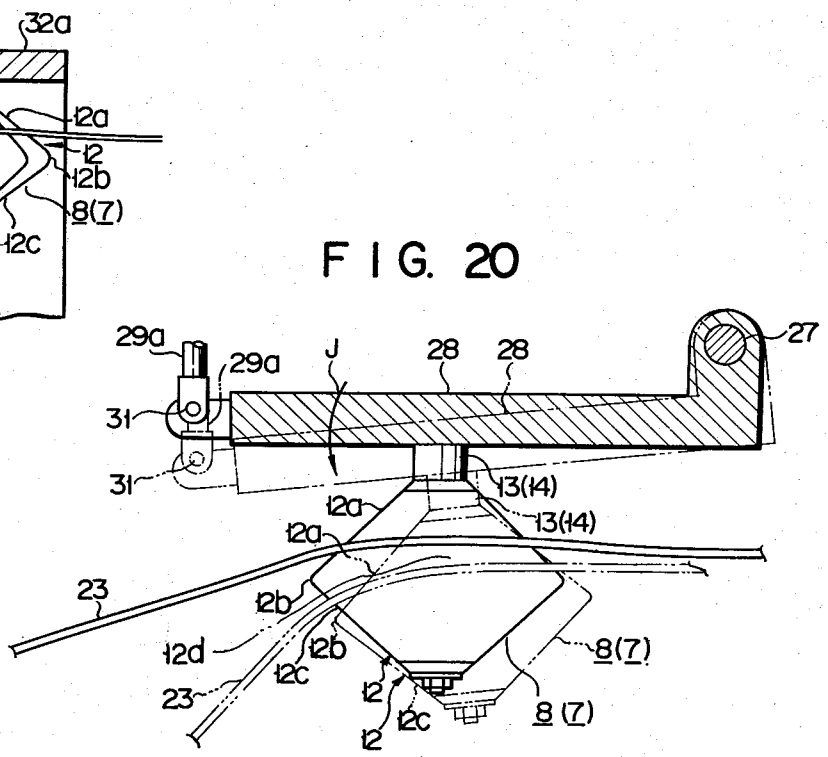
FIG. 20 is an enlarged sectional view showing the operation of the main part of FIG. 19.

An angle $\alpha$ (FIG. 19) defined by the cable 23 with the sea level when pulled out of the sea on to the deck of the vessel 21 varies with the running speed of the vessel 21 or the flowing speed of a tide. Now let it be assumed that the cable 23 which should normally pass, as shown by solid lines in FIG. 20, between the paird rotors 7, 8 on the adjusting plate 28 each occupying a solid line position happens to be drawn out of the sea as indicated by two-dot-chain lines. Then, if there is no means for lowering the rotors 7, 8, the drawn cable 23 lies below the detent elements 12*b* of the metal supporting members 12 of both rotors 7, 8 and consequently sways sideways to be caught by the metal support members 12 of either or both of the two rotors 7, 8, thus undesirably failing to run smoothly. In such case, the hydraulic piston-cylinder assembly 29 is operated to cause the piston rod 29*a* to protrude out of the cylinder 29*b*, thereby rotating the adjusting plate 28 about the pivotal shaft 27 in the direction of an arrow J shown in FIG. 20, until the rotors 7, 8 are lowered and brought to the two-dot-chain line position. As the result, the cable 23 can ride on the detent elements 21*b*. In other words, the cable 23 is brought to the upper half portions 12*a* of the metal supporting members 12 or the V-shaped supporting portion 12*d* of the supporting members 12 and is prevented from being caught by the metal supporting members 12 of the rotors 7, 8 on the adjusting plate 28. Conversely, where the cable 23 is lifted to the solid line position when the rotors 7, 8 occupy the two-dot-chain line positions (FIG. 13), the hydraulic piston-cylinder assembly 29 is operated to retract the piston rod 29*a*, thereby bringing the rotors 7, 8 to the solid line positions (FIG. 20). If, in a case different from the above-mentioned embodiment where the cable guiding device of this invention is applied to the vessel 21, the second upright gate type support pole 32 lacks rotors 7, 8, the cable 23 pulled out of the rotors 7, 8 on the adjusting plate 28 sags downward to occupy a position below the detent elements 12*b* of the metal supporting members 12. Under such condition, the cable 23 is caught by the metal supporting members 12 of either or both of the rotors 7, 8 on the adjusting plate 28 failing to be smoothly pulled. With the embodiment of FIGS. 17 to 20, the upright gate type support pole 32 is also provided with rotors 7, 8. Therefore, after leaving the rotors 7, 8 on the adjusting plate 28 of the inclined gate type support pole 26, the cable 23 smoothly travels above the detent elements 12*b* of the metal supporting members 12 of the rotors 7, 8, thus being prevented from being caught by the metal supporting members 12 on the adjusting plate 28.

As described above, each cable guiding device of the embodiment of FIGS. 17 to 20 has a pair of rotors 7, 8, enabling the cable 23 to be carried smoothly with the same effect as the preceding embodiments of FIGS. 1 to 9.

The adjusting plate 28 used in the embodiment of FIGS. 17 to 20 swings vertically by means of the piston-cylinder assembly 29, thereby enabling the height and the inclination angle of the rotors 7, 8 on the adjusting plate 28 to vary with the condition in which the cable 23 is pulled out of the sea, and in consequence eliminating the undesirable possibility of the cable 23 being caught by the metal supporting members 12 of the rotors 7, 8, and failing to run smoothly.

Figure 21:
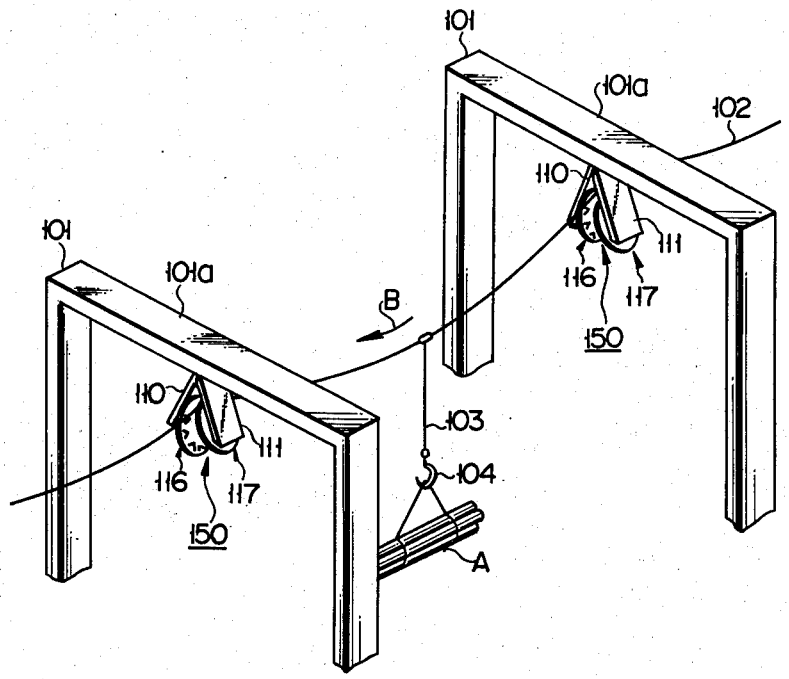
FIG. 21 is an oblique view of a lumber-transporting aerial cableway to which a cable guiding device according to a still further embodiment of the invention is applied.

FIGS. 21 to 25 represent still another embodiment of this invention. Like FIG. 1, FIG. 21 shows a cableway system for transporting a bundle of cut down pieces of lumber from a felling site to the nearest railroad station. Gate type support poles 101, horizontal beams 101*a*, cable 102, suspension ropes (or suspension members) 103 and hooks 104 respectively correspond to the gate type support poles 1, horizontal beams 1*a*, cable 2, suspension ropes 3 and hooks 4. Cable guiding devices 150 are fitted to the underside of the corresponding horizontal beams 101*a*.

Figure 22:
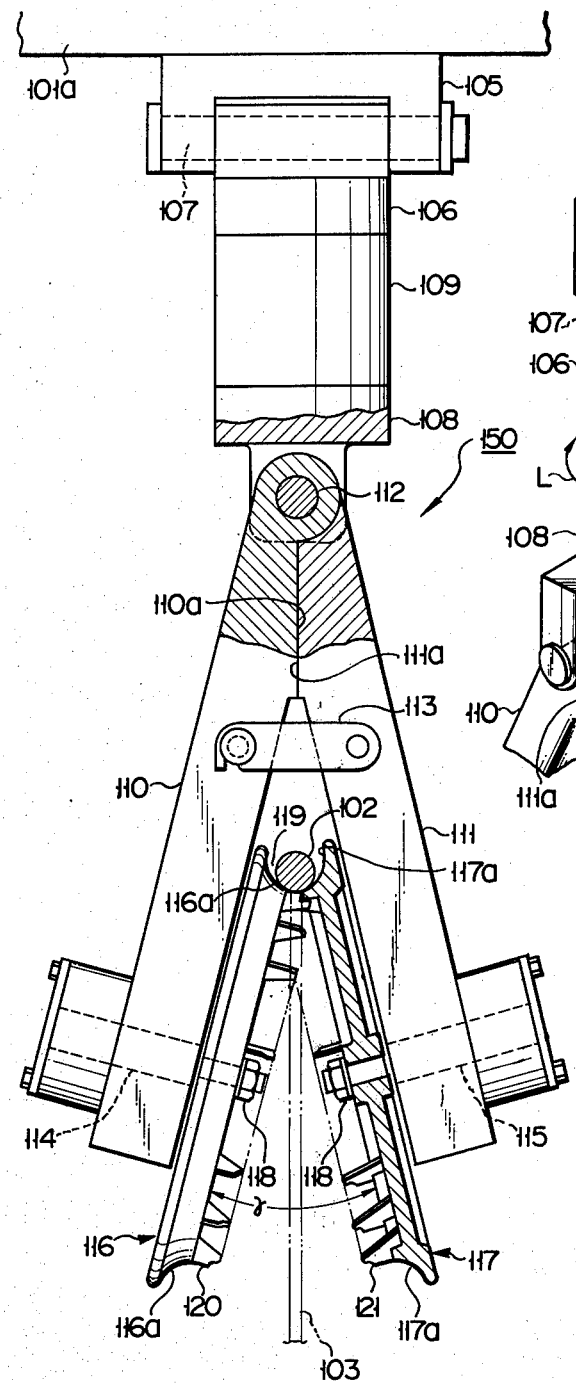
FIG. 22 is a partially broken front view of a cable guiding device of FIG. 21.
Figure 23:
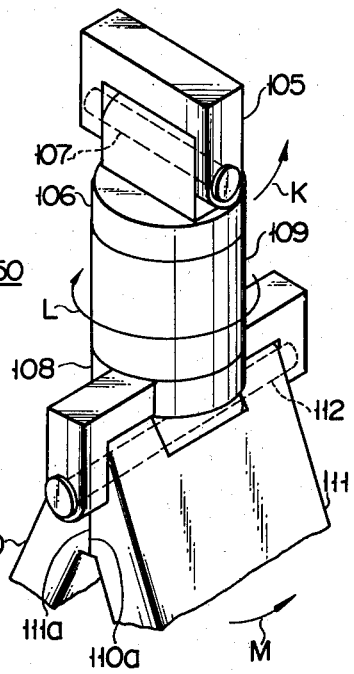
FIG. 23 is an enlarged oblique view of the pivotal portion of FIG. 22.

Referring to FIGS. 22 and 23, the cable guiding device 150 comprises a support block 105 shaped like an inverted U-shape and fixed to the underside of the horizontal beam 101*a* of the gate type support pole 101; a vertical shaft 106 pivoted to the support block 105 by means of a horizontal shaft 107 so as to move in the direction of an arrow K (FIG. 16) and the opposite direction thereto in a vertical plane; a support member 108 shaped like an inverted U-shape and pivoted to the vertical shaft 106 by means of a swivel joint 109 so as to rotate in the direction of an arrow L and the opposite direction thereto in a horizontal plane; and a pair of holding plate members 110, 111 whose upper portions are pivoted to the support member 108 by means of a pivotal shaft 112 so as to rotate in the direction of an arrow M and the opposite direction thereto in a plane perpendicular to the traveling direction of the cable 102. Those upper inclined inner planes 110*a*, 111*a* of both holding plate members 110, 111 face or contact each other. The holding plate members 110, 111 are connected together in the form of a substantially inverted V-shape by means of a latch 113 (FIG. 22). Rotatable shafts 114, 115 are rotatably mounted in the holding plate members 110, 111. A pair of rotatable disks (or rotors) 116, 117 are fixed to the mutually facing ends of the rotatable shafts 114, 115 by means of nuts 118. Those rotatable disks (or rotors) 116, 117 face each other in such an inclined state that the lower portions of the rotatable disks (or rotors) 116, 117 are spaced progressively wider. The minimum space between the uppermost portions of the rotatable disks (or rotors) 116, 117 is chosen to be slightly larger than the diameter of the suspension rope 103. The peripheral edge 116*a* or 117*a* of each of the paired rotatable disks 116, 117 has a cross section shaped like an arcuate concave form. Thus, the uppermost engaged portions of the rotatable disks 116, 117 jointly constitute a substantially U-shaped groove 119 which constitutes a cable supporting portion. A plurality of detent elements 120, 121 are provided on the periphery of the mutually facing sides of the rotatable disks 116, 117 at a prescribed circumferential interval. These detent elements are formed of triangular pieces punched out of an iron plate and, for example, welded to the mutually facing sides of the rotatable disks 116, 117. These rotatable disks 116, 117 rotate with the detent elements 120, 121 engaged with each other of the mutually facing uppermost portions of the rotatable disks 116, 117 or proximity thereof when the holding plate members 110, 111 are locked by the latch 113. The cable 102 is supported in the U-shaped groove (or cable supporting portion) 119.

There will now be described the operation of the embodiment of FIGS. 21 to 25 constructed as described above. Where the cable 102 holding suspension ropes 103 each carrying, for example, a bundle A of cut down pieces of lumber is made to run in the direction of an arrow B shown in FIG. 21 by means of a driving device (not shown), the rotatable disks 116, 117 are rotated in the directions of arrows N and P indicated in FIG. 24 by friction between the disks 116, 117 and cable 102. At this time, the detent elements 120, 121 are engaged with each other at the mutually facing uppermost portions of the rotatable disks 116, 117. Those portions of the peripheral edges 116*a*, 117*a* having an arcuate concave cross section which are disposed adjacent to the engaged detent elements 120, 121 and jointly constitute the U-shaped groove 119 bear the load of the cable 102 and the bundle A of lumber pieces.

Figure 24:
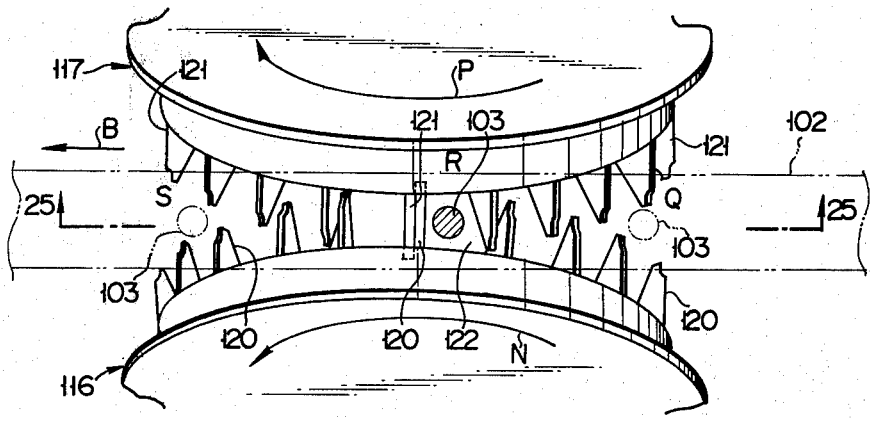
FIGS. 24 and 25 show the manner in which the embodiment of FIG. 23 transports lumber.
Figure 25:
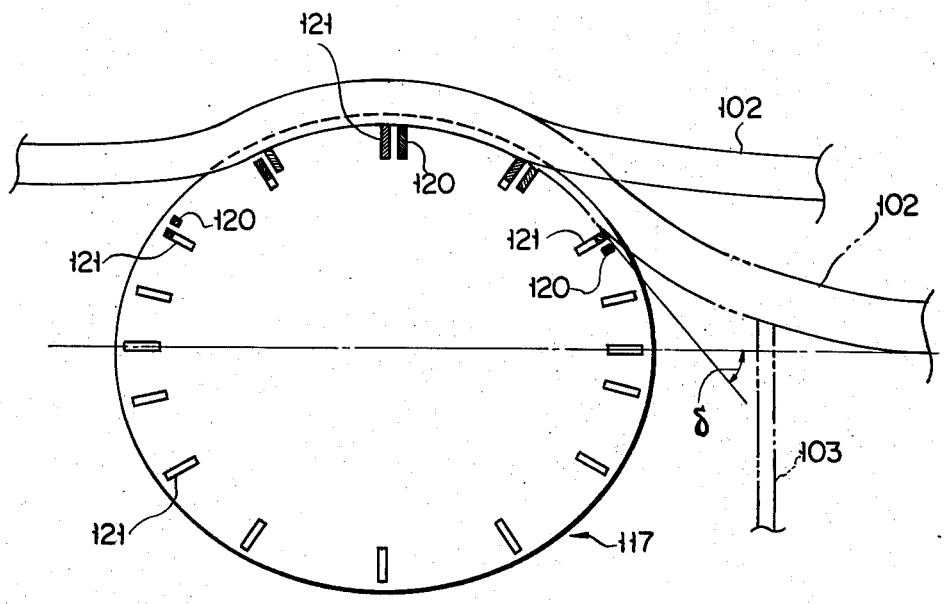

There will now be described by reference to FIGS. 24 and 25 the manner in which the suspension rope 103 carrying the bundle A of lumber pieces passes between the rotatable disks 116, 117. When the suspension rope 103 is drawn near the rotatable disks 116, 117, the cable 102 considerably sags downward from the rotatable disks 116, 117 under the load of the lumber bundle A, as shown by two-dot-chain lines in FIG. 25. When reaching the rotatable disks 116, 117, as shown by Q in FIG. 24, the suspension rope 103 is positioned at the back of that pair of the detent elements 120, 121 which are just about to engage each other. With the rotation of the disks 116, 117, the engaged detent elements 120, 121 are also rotated in the directions of the arrows N and P. The suspension rope 103 occupies a position in a space 122 provided at the back of the engaged detent elements 120, 121 and passes between the rotatable disks 116, 117 in this state. When the paired detent elements are disengaged from each other, the suspension rope 103 leaves the space 122 as shown by S in FIG. 24. In this case, the lower half portions of the disks 116, 117 are rotated in a direction opposite to that in which the cable 102 travels. Since, however, the lower half portions of the rotatable disks 116, 117 are spaced progressively wider, the detent elements 120, 121 are prevented from being caught by the lower half portions, thereby enabling the suspension rope 103 to pass between the rotatable disks 116, 117 without any obstruction.

With the embodiment of FIGS. 21 to 25, the detent elements are engaged with each other in most of the upper half portions of the peripheral edges 116*a* and 117*a* of the rotatable disks 116, 117. Therefore, the cable 102 is little likely to be caught between the detent elements 120, 121 even where the cable 102 considerably sinks when the suspension rope 103 is brought near the rotatable disks 116, 117. For example, where the cable 102 sinks at a suspension angle $\delta$ (FIG. 25) falling within about 70° in case the angle $\gamma$ between the rotatable disks 116, 117 is 30° (FIG. 22), the cable 102 is not caught between the detent elements 120, 121, as experimentally proved. Even where, with the embodiment of FIGS. 21 to 25, the lumber bundle A has a considerably great weight, the cable 102 is little liable to sink at a larger angle $\delta$ than 70° and consequently is securely supported for a smooth run.

With the embodiment of FIGS. 14 to 18, the cable 102 should always pass through the U-shaped groove 119 (FIG. 22). As shown in FIG. 23, however, the holding plate members 110, 111 swing about the pivotal shaft 107 in the direction of the indicated arrow K or in a direction opposite thereto, and about the pivotal shaft 112 in the direction of the arrow M or in a direction opposite thereto or about the swivel joint 109 in the direction of the arrow L or in a direction opposite thereto. When, therefore, the cable 102 swings sideways, the U-shaped groove 119 is always aligned with the traveling direction of the cable 102 for its smooth passage therethrough.

With the embodiment of FIGS. 21 to 25, the paired holding plate members 110, 111 rotate in the direction of the arrow M and in a direction opposite thereto. When, therefore, the latch 113 is released to rotate the holding plate members 110, 111 in a mutually opening direction, thereby disengaging the detent elements of the rotatable disks 116, 117, an interval between the disks 116, 117 becomes wider to enable the cable 102 to be easily lifted over the U-shaped groove 119 and consequently supported on the cable guiding device.

Figure 26:
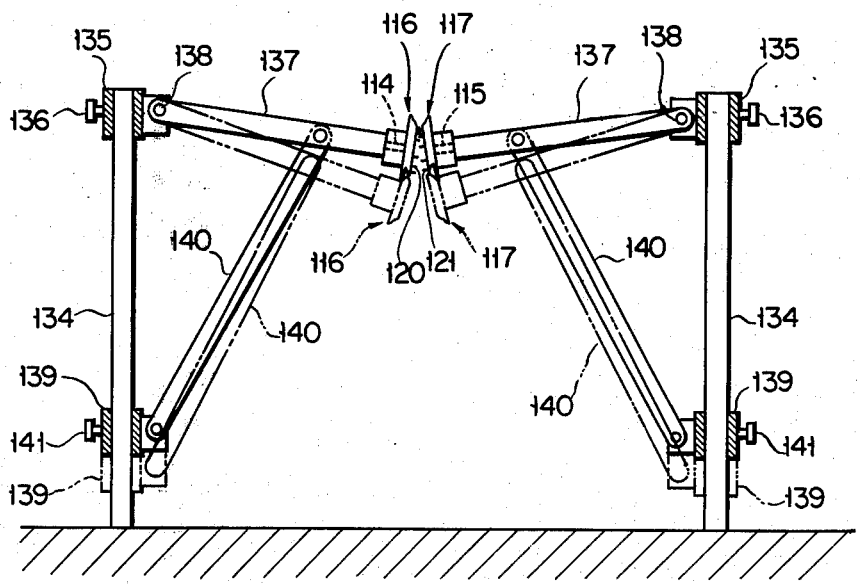
FIG. 26 is a front view of a cable guiding device according to a still further embodiment of the invention.

There will now be described by reference to FIG. 26 the operation of a further embodiment of this invention. The parts of FIG. 26 which are the same as those of FIG. 22 are denoted by the same numerals, description being given only of different parts. A cylindrical member 135 is fixed by a screw 136 to the upper end of each of a pair of spatially erected support poles 134. An arm 137 has one end pivoted to the corresponding cylindrical member 135 by means of a pivotal shaft 138 so as to be rotated vertically. Rotatable shafts 114, 115 are pivoted to the mutually facing ends of both arms 137. The mutually facing sides of the rotatable shafts 114, 115 are fitted with rotatable disks 116, 117 similar to those of FIGS. 21 to 25. A vertically slidable tube 139 is mounted on an intermediate portion of each support pole 134. The sliding tube 139 and an intermediate portion of the corresponding arm 137 are connected by a link 140 at corresponding ends thereof. The sliding tube 139 is set at a proper height of the support pole 134 by means of a screw 141. The arms 137 are made to incline downward toward the rotatable disks 116, 117 by cooperation of the support pole 134 and link 140. This arrangement causes the lower portions of the rotatable disks 116, 117 to be spaced progressively wider. The disks 116, 117 are rotated with their detent elements 120, 121 engaged with each other at the mutually facing uppermost portions of the disks 116, 117. The embodiment of FIG. 26 attains the same effect as that of FIGS. 21 to 25. Where the sliding tube 139 slides vertically along the support pole 134 after the screw 141 is loosened, the arm 137 swings vertically about the pivotal shaft 138 with the resultant change in the inclination angle, thereby varying the inclination angle and height of the rotatable disks 116, 117.

Figure 17:
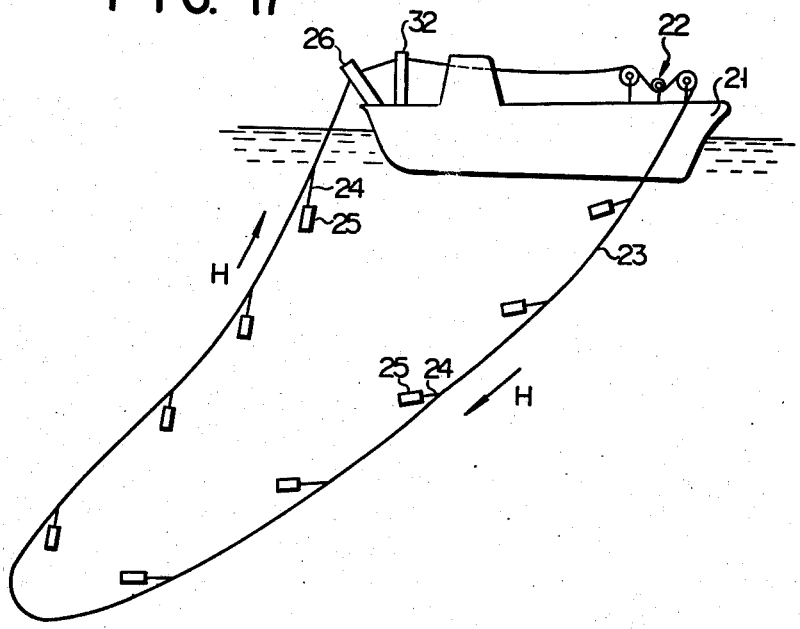
FIG. 17 shows the cable guiding device of FIGS. 2 to 4 applied to an ore collecting vessel.

The embodiment of FIGS. 21 to 25 is applicable to a vessel for collecting ores out of the sea bed like the embodiment of FIGS. 17 and 18.

The cable guiding device of this invention can be used not only in the transport of lumber and with an ore collecting vessel for collecting sea bed ores, but also with aerial cable ways for carrying persons and many other articles.

What is claimed is:

1. A cable guiding device for a cable having carrier suspension members hanging from said cable comprising:

supporting means, a pair of rotors, each of said rotors comprising;

a vertical shaft rotatably mounted on said supporting means and disposed adjacent to the shaft of the other rotor, a plurality of detent elements formed on the periphery of the shaft engageable with the detent elements of the other rotor, said detent elements being arranged at an equal circumferential interval as any adjacent pairs of the engaged detent elements of both the rotors defining a space for admitting therein each of said carrier-suspension members hanging from the cable; and cable guiding means formed on the upper portion of the shaft and forming a V-shape together with the cable guiding means of the other roller so as to receive and guide the cable, said rotors being rotated together with said detent elements by the advancing movement of the cable so as to allow the carrier-suspension members to pass between the rotors.

2. A cable guiding device according to claim 1, wherein the paired rotors are formed of rotatable disks which face each other such that the lower portions of the rotatable disks are spaced progressively wider; said detent elements are provided on the periphery of the disks at an equal circumferential interval so as to engage each other at the uppermost portions of the rotatable disks and in the proximity thereof.

3. A cable guiding device according to claim 1, further comprising an adjusting plate one lateral edge of which is swingably mounted on the underside of the horizontal beam of a gate type support pole by means of a horizontal pivotal shaft and to the underside of which the paired rotors are rotatably fitted, and a piston-cylinder assembly which is provided between the horizontal beam of the gate type support pole and that edge of the fitting plate which is opposite to said one lateral edge, and is adjustable the height of the rotors by varying the inclination of the adjusting plate.

4. A cable guiding device according to claim 1, wherein each of said detent elements comprises a wing member having its upper surface inclined downward from the periphery of the respective shaft.

5. A cable guiding device according to claim 4, wherein the cable guiding means are bar-like supporting members which extend downward from one end of each of the central shafts of the rotors.

6. A cable guiding device according to claim 5, wherein the supporting members are bent at a substantial central portion so as to extend in the radial and outward direction of the corresponding central shaft and have upper and lower ends fixed to the central shaft, the bent central portion of each supporting member comprises a detent element, and the upper half portions of the supporting members above the bent central portion comprise the cable guiding means.

7. A cable guiding device according to claim 5, wherein each supporting member has the central portion fixed to the corresponding central shaft by means of a support rod, and the lower end portion of each of the supporting member comprises the detent element.

8. A cable guiding device according to claim 5, wherein a roller is provided on the upper end of each of the supporting members concentrically with the central shaft of the corresponding supporting member to prevent the cable from swaying sideways.

9. A cable guiding device according to claim 4, wherein a plurality of wing members having a triangular vertical cross section whose inclined plane extends radially downward are provided on the periphery of the pivotal central shaft at an equal circumferential interval, the inclined planes of the triangular wing members comprising cable guiding means, the intersected portion of the inclined planes and bases of the triangular wing members comprising detent elements.

10. A cable guiding device according to claim 9, wherein the wing members are securely fixed to the periphery of the central shaft of each rotor at an equal circumferential interval.

11. A cable guiding device according to claim 9, wherein the wing members are integral with the central shaft of each rotor.

12. A cable guiding device according to claim 2, wherein the cable guiding means is jointly defined by the peripheral edge of each disk having a cross section shaped like an arcuate cavity continuously extending from the detent elements.

13. A cable guiding device according to claim 12, further comprising a pair of holding plate members connected together in the form of an inverted V-shape so as to rotatably support the mutually facing rotatable disks.

14. A cable guiding device according to claim 13, wherein the holding plate members are pivotally supported at the upper ends thereof so as to be opened and closed, and has a latch for locking the holding plate members together so as to normally cause the detent elements of the rotatable disks to engage each other at the uppermost portions of the rotatable disks and in the proximity thereof.

15. A cable guiding device according to claim 14, wherein the pivotal portion of the holding plate members is provided with a swivel joint for swiveling the holding plate members together with the rotatable disks in a horizontal plane.

16. A cable guiding device according to claim 14, wherein the holding plate members are mounted on a support pole at the swivel joint by means of a horizontal shaft so as to swing lengthwise of the cable.

17. A cable guiding device according to claim 2, wherein a pair of arms inclining downward toward the opposite support poles have one end pivoted to the corresponding support poles; the paired rotatable disks are rotatably mounted on the mutually facing ends of the arms; and there are provided a pair of links, each of which is pivoted at one end to an intermediate portion of the corresponding arm and is connected at the other end to the corresponding support pole so as to slide thereon vertically.

18. A cable guiding device according to claim 4, wherein each of said shafts has a conical surface continuous with the upper surface of each of the detent elements formed on the respective shaft.

19. A cable guiding device according to claim 18, wherein said detent elements comprise V-shaped supporting bars.

20. A cable guiding device according to claim 18, wherein each of said detent elements comprises a triangular plate.

21. A cable guiding device according to claim 20, wherein said detent elements are formed integral with the respective central shafts.

22. A cable guiding device according to claim 21, wherein said detent elements are shaped into gear teeth.

23. A cable guiding device according to claim 20, wherein said detent elements are fixed to the respective central shafts.

24. A cable guiding device according to claim 4, wherein said detent elements each comprise a supporting bar extending outward and continuously with the conical surface of the respective central shafts.

25. A cable guiding device according to claim 20, wherein said triangle plates are fixed to the respective central shafts.

26. A cable guiding device according to claim 25, wherein said triangle plates have each a vertical base.

* * * * *